US007794520B2

(12) United States Patent
Murty et al.

(10) Patent No.: US 7,794,520 B2
(45) **Date of Patent: *Sep. 14, 2010**

(54) METAL MATRIX COMPOSITES WITH INTERMETALLIC REINFORCEMENTS

(75) Inventors: Gollapudi S. Murty, Wheeling, WV (US); Brian E. Joseph, Wheeling, WV (US)

(73) Assignee: Touchstone Research Laboratory, Ltd., Triadelphia, WV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/917,311

(22) Filed: Aug. 13, 2004

(65) Prior Publication Data

US 2005/0011591 A1 Jan. 20, 2005

Related U.S. Application Data

(63) Continuation-in-part of application No. 10/460,312, filed on Jun. 13, 2003, now Pat. No. 6,849,102.

(60) Provisional application No. 60/387,894, filed on Jun. 13, 2002.

(51) Int. Cl.
*C22C 1/04* (2006.01)

(52) U.S. Cl. ..... 75/245; 75/246; 75/247; 75/248; 75/249

(58) Field of Classification Search ..... 75/249
See application file for complete search history.

(56) References Cited

U.S. PATENT DOCUMENTS 3,147,111 A * 9/1964 Foerster ..... 75/338
4,347,076 A * 8/1982 Ray et al. ..... 75/255
4,435,213 A * 3/1984 Hildeman et al. ..... 75/249
4,623,388 A * 11/1986 Jatkar et al. ..... 75/232
4,737,339 A * 4/1988 Couper ..... 419/23
4,756,753 A * 7/1988 Miura ..... 75/232
4,836,982 A * 6/1989 Brupbacher et al. ..... 420/129
5,049,211 A * 9/1991 Jones et al. ..... 148/437
5,368,657 A * 11/1994 Anderson et al. ..... 148/400
5,449,421 A * 9/1995 Hamajima et al. ..... 148/415
5,532,069 A * 7/1996 Masumoto et al. ..... 428/552
5,614,150 A * 3/1997 Bowden ..... 420/590
5,851,317 A * 12/1998 Biner et al. ..... 148/403
5,858,132 A * 1/1999 Bell et al. ..... 148/441
6,849,102 B2 * 2/2005 Murty et al. ..... 75/245

FOREIGN PATENT DOCUMENTS

JP 7-331356 * 12/1995

* cited by examiner

*Primary Examiner*—Roy King
*Assistant Examiner*—Ngoclan T Mai

(57) ABSTRACT

A discontinuously reinforced metal matrix composite wherein the reinforcing material is a particulate binary intermetallic compound is described along with methods for preparing the same. The binary intermetallic compound includes the same type of metal as is the principal matrix metal in combination with one other metal. The particle size of the particulate binary intermetallic compound may be less than about 20 μm and may be between about 1 μm and about 10 μm. The intermetallic particles may be present in the discontinuously reinforced metal matrix composites in an amount ranging from about 10% to about 70% by volume. The discontinuous reinforced metal matrix composites of the invention may be used in structures requiring greater strength and stiffness than can be provided by matrix metal alone. The materials of the invention may be used for vehicle parts, structural materials, and the like.

35 Claims, 3 Drawing Sheets

METAL MATRIX COMPOSITES WITH INTERMETALLIC REINFORCEMENTS

CROSS-REFERENCE TO RELATED APPLICATIONS

This application is a continuation in part and claims priority to U.S. patent application Ser. No. 10/460,312, filed Jun. 13, 2003, now U.S. Pat. No. 6,849,102 which is based on and claims priority to U.S. Provisional Patent Application No. 60/387,894, filed Jun. 13, 2002, both of which are herein incorporated by reference in their entirety.

BACKGROUND OF THE INVENTION

A composite material is composed of one or more reinforcing materials embedded in a matrix material. Composite materials having high degrees of utility typically exhibit mechanical, or other properties, superior to those of the individual materials from which the composite was formed. A common example of a composite material is fiberglass. Fiberglass is produced by imbedding glass fibers, which are the reinforcing material, in a resin, which constitutes the matrix material. Composites utilizing organic polymeric matrix materials are well known and have been widely utilized. However, the properties of such composites, although sometimes exceptional, do have limitations with respect to strength and temperature compatibility. Other composites have been developed that utilize metals as the matrix material. Such metal matrix composites can exhibit properties, such as temperature resistance, superior to those of organic polymeric matrix composites.

Generally, composite materials constitute a class of materials that provide for design flexibility by allowing their properties to be tailored within limitations according to the specific requirements for different applications. For example, metal matrix composites, such as aluminum matrix composites may be used for a variety of structural and non-structural applications, including applications for electronics, automotive and aerospace industries.

Composite materials are generally classified on the basis of the shape and size of the reinforcements. One type of composite material, a unidirectionally aligned fiber composite, contains fibers of a critical length that are arranged in parallel and are aligned along the length of the composite. FIG. 1 shows a representation of a magnified view of such a unidirectionally aligned fiber composite (10) consisting of a matrix metal (20) which is reinforced with ceramic fibers (30). Another type of composite material is a discontinuous fiber composite. In such a composite, relatively short lengths of fiber reinforcement, sometimes referred to as whiskers, are arranged randomly in the matrix material. FIG. 2 shows a representation of a magnified view of a discontinuously reinforced metal matrix composite (40). The reinforcing material used in this composite is a discontinuous ceramic fiber (50) and the matrix material (60) is a metal. Discontinuously reinforced composites may also be prepared using a particulate reinforcement dispersed in a matrix material. A magnified view of such a discontinuously reinforced particulate composite (70) is represented in FIG. 3. In this representation, the particulate reinforcements (80) are dispersed in the metal matrix (90).

The properties of composite materials are generally influenced by the properties of the matrix material as well as by the properties, including type, shape, size, and volume fraction, of the reinforcing material. The main strengthening mechanism of unidirectionally aligned fiber composites is based on load transfer from the matrix to the fibers. Therefore the load is mainly carried by the fibers. The highest levels of strength and stiffness are typically attained using continuous, strong, fibers aligned in the direction of loading, such as is provided by continuous fiber composites, as the strong fibers carry the majority of the load. Although unidirectionally aligned fiber composites, including continuous fiber composites, have superior strength in the direction of the fibers, their applications are often limited by their high costs of production, the problems associated with their processing, and their inferior transverse properties.

Generally, discontinuously reinforced composites are weaker than are unidirectionally aligned fiber composites along the fiber direction. However, discontinuously reinforced matrix composites are attractive for reasons such as their low cost and increased flexibility in processing. Additionally, such composites have isotropic mechanical properties. This isotropic nature can result in discontinuously reinforced composites being preferable to unidirectionally aligned fiber composites in applications requiring composite strength in more than one direction.

Discontinuously reinforced particulate composites can encompass a very wide range of reinforcing particulate sizes. For example, one type of discontinuously reinforced particulate composite is dispersion strengthened metals. Dispersion strengthened metals are reinforced with submicron sized hard particles that directly inhibit dislocation motion in the matrix through the Orowan mechanism. Generally, the required volume fraction of the particulate phase in dispersion strengthened metals is relatively small. Such dispersion strengthened metals may be used, for example, for elevated temperature applications. However, the preparation of such dispersion strengthened materials typically requires extensive and expensive processing.

A second type of discontinuously reinforced particulate composite utilizes particulates of about 1 micron to 50 micron size. In this particulate reinforcement size range stiffness and strength enhancements can occur. Such composites are typically less difficult to produce than the first type.

A third type of discontinuously reinforced particulate composite utilizes even coarser particulates. The size of the particulates exhibited in these types of discontinuously reinforced particulate composites is in the range of about 50 to 250 μm. This third type of particulate composites typically provides greater production flexibility and ease of production. Applications for which such composites are typically useful are those requiring wear resistance.

There are various factors that influence the mechanical behavior of particulate composites. These factors can include the nature and type of the particulate phase (strength and deformability), particle size, volume fraction, shape of particles (aspect ratio), coefficient of thermal expansion (CTE) of the matrix and the particulate material, bond strength between the matrix and the particulate material, and overall matrix characteristics.

With respect to the three types of composites previously discussed, the strengthening mechanism of the first type of composites is primarily dispersion strengthening. The strengthening mechanism of those composites of the second and third types generally involves several components, such as matrix strengthening, thermal residual stresses through coefficient of thermal expansion (CTE) mismatch, and load transfer from the matrix to the particles. The aspect ratio of the particles is an important factor that influences the load transfer from the matrix to the particles. The extent of strengthening in these particulate composites increases as the particle size decreases and also with the increase in the amount of particulate phase.

Load sharing by the particles occurs in a discontinuously reinforced matrix. Typically, however, particles share a smaller amount of the load than do fibers. Matrix strengthening also contributes to the overall strength of discontinuously reinforced metal matrix composites. In metal matrixes, the reinforcing effects of particulates include various other strengthening mechanisms. For example, the particulates may constrain plastic deformation of the metal matrix.

For example, particulate silicon carbide (SiC) is commonly used as a reinforcing material in discontinuously reinforced metal matrix composite materials. In particular, composites composed of aluminum matrices with silicon carbide particulates, as the reinforcing material, are commonly used. However, the load sharing by the silicon carbide particles is limited by the inherently weaker bond exhibited between metal/ceramic systems, such as between aluminum and silicon carbide.

Therefore there is need for a discontinuously reinforced metal matrix composite that has improved strength, stiffness and toughness and provides greater flexibility in processing. There is also a need for a processing method which allows for better processing control.

SUMMARY OF THE INVENTION

The invention provides a discontinuously reinforced metal matrix composite wherein the reinforcing material is a particulate binary intermetallic compound. The binary intermetallic compound of the present invention may be comprised of the same type of metal as is the principal matrix metal in combination with one other metal. The particle size of the particulate binary intermetallic compound may be less than about 20 μm, and in certain embodiments, between about 1 μm and about 10 μm. In some embodiments, the intermetallic particles are present in the discontinuously reinforced metal matrix composites of the present invention in an amount ranging from about 10% to about 70% by volume. The discontinuously reinforced metal matrix composites may be used in structures requiring greater strength and stiffness than can be provided by matrix metal alone. The materials of the invention may be used for vehicle parts, structural materials, and the like.

The invention also provides methods by which such a discontinuously reinforced metal composite can be prepared. Fore example, metal matrix composites may be prepared by atomizing a molten alloy of at least two different metals to form powder particles comprising a metal matrix and intermetallic particles, wherein the intermetallic particles may be dispersed in the metal matrix in an amount of at least 20% by volume.

Additionally, a molten alloy of at least two different metals may be atomized to produce metal matrix powder particles comprising intermetallic particles, with a size ranging from 1 μm to about 10 μm dispersed in the metal matrix. The preparation methods may also be practiced such that intermetallic particles having a size ranging from 1 μm to about 10 μm are dispersed in the metal matrix in an amount of at least 20% by volume The intermetallic particles are particles of a binary intermetallic compound wherein the binary intermetallic compound is comprised of the same type of metal as is the principal matrix metal in combination with one other metal.

DETAILED DESCRIPTION OF THE INVENTION

Figure 1:
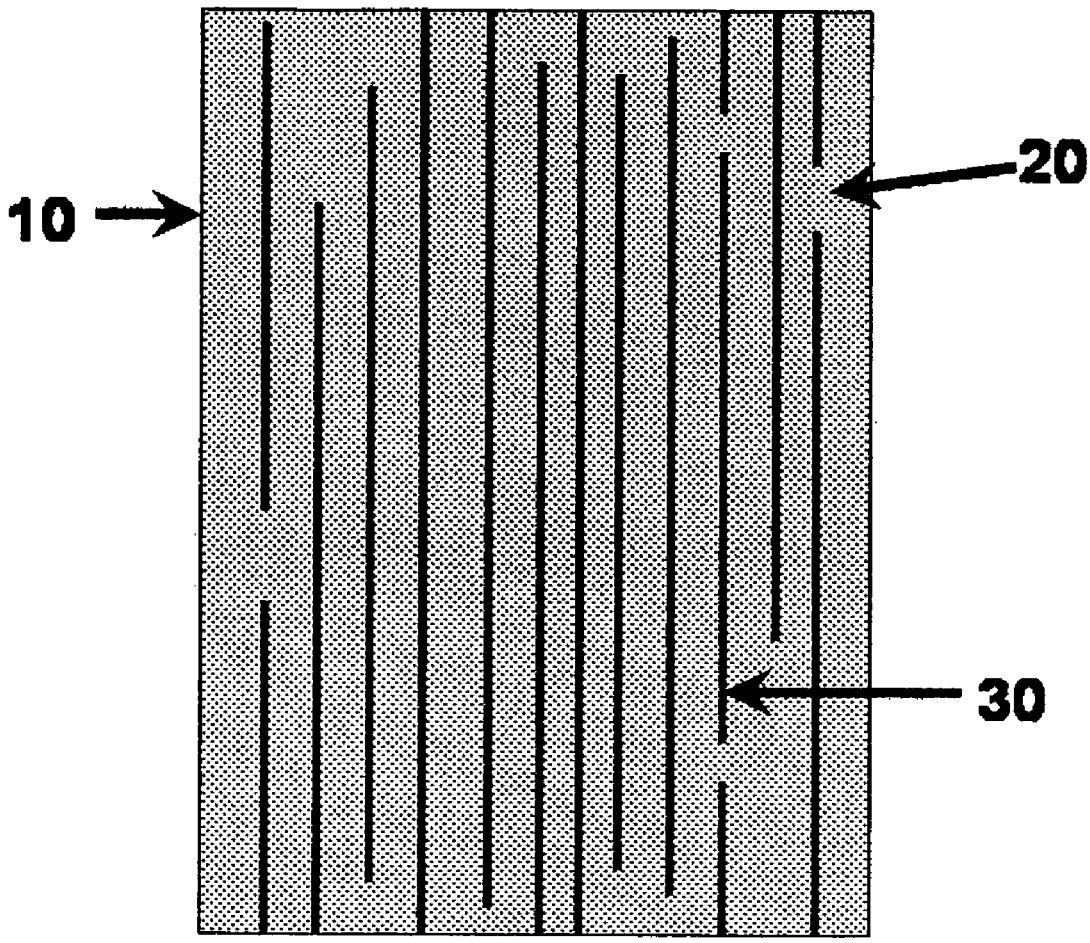
FIG. 1 is a representation of a magnified view of a unidirectionally aligned ceramic fiber metal matrix composite.
Figure 2:
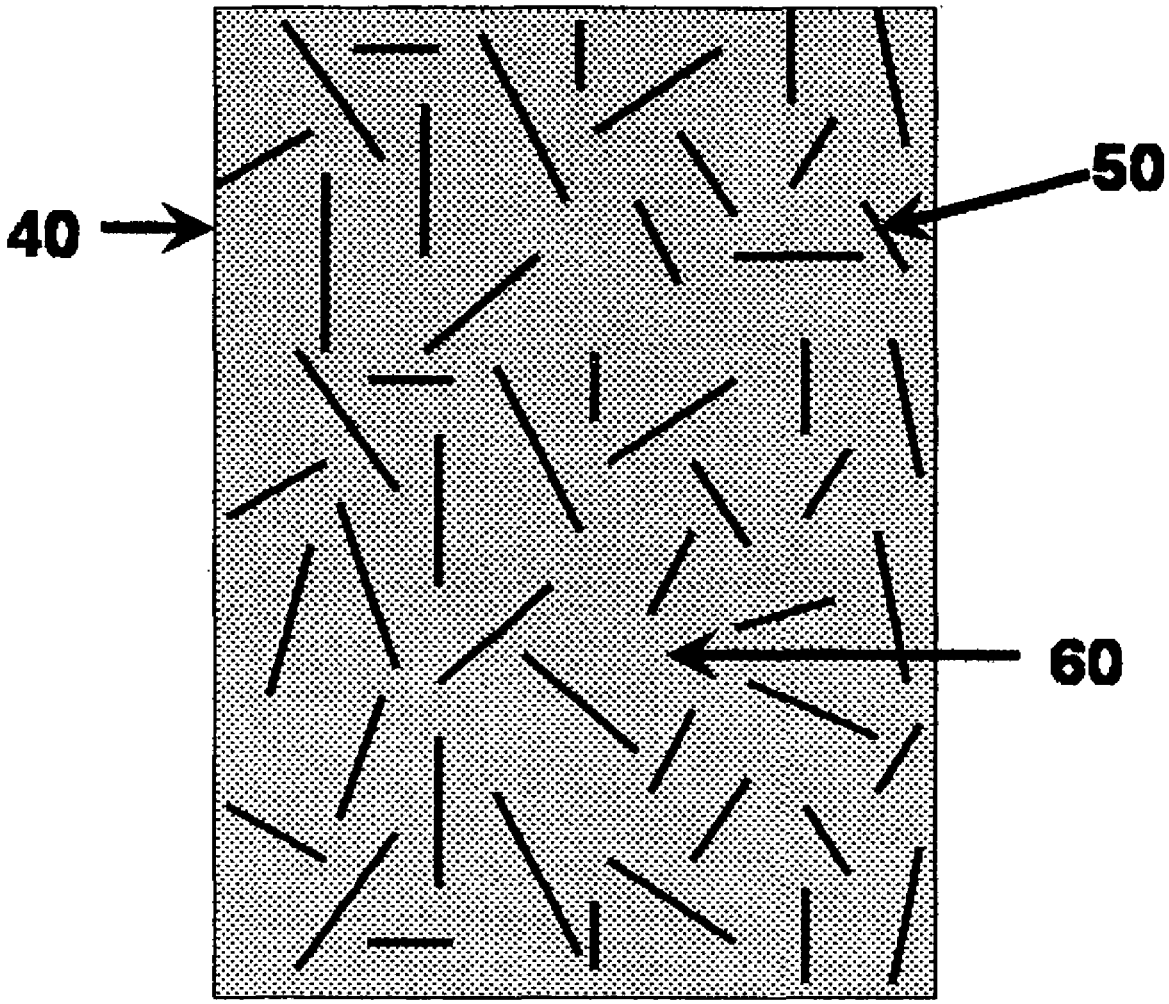
FIG. 2 is a representation of a magnified view of a discontinuous and randomly oriented ceramic fiber metal matrix composite.
Figure 3:
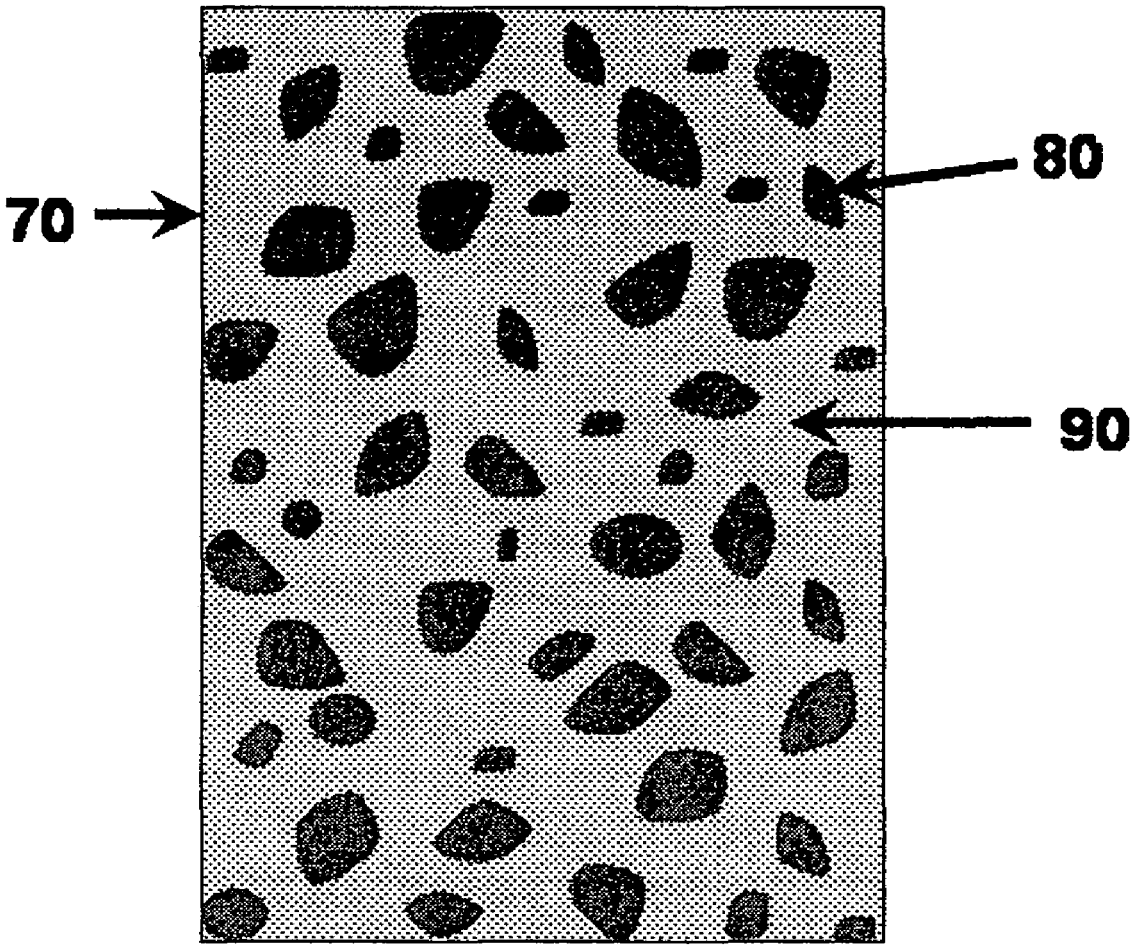
FIG. 3 is a representation of a magnified view of a discontinuous metal matrix composite in accordance with an embodiment of the invention.

The invention provides a discontinuously reinforced metal matrix composite wherein the reinforcing material is a particulate binary intermetallic compound. The binary intermetallic compound may be comprised of the same type of metal as is the principal matrix metal and one other metal. The particle size of the particulate binary intermetallic compound is preferably less than about 20 μm and more preferably between about 1 μm and about 10 μm. Preferably, the intermetallic particles are present in the discontinuously reinforced metal matrix composites of in an amount ranging from about 10% to about 70% by volume. The discontinuous reinforced metal matrix composites may be used in structures requiring greater strength and stiffness than can be provided by the matrix metal alone. The materials of the invention may be used for vehicle parts, structural materials, and the like. The invention also provides methods by which such discontinuously reinforced metal composite can be prepared.

The matrix metal of the discontinuously reinforced metal composite may be an individual metal or an alloy. In all cases, the matrix metal will have a metal component, referred to as the principal matrix metal, which is the predominant or major constituent of the matrix metal. For alloys, the principal matrix metal is that individual metal exhibiting the highest compositional mole fraction within the group of those metals which comprise the mixture or alloy.

The principal matrix metal in combination with one other metal forms the intermetallic compound. As the intermetallic compound is comprised of only two components, it is a binary intermetallic compound. There may be a large number of intermetallic compounds which may be formed in accordance with the invention. As shown in Table 1, using aluminum as the principal matrix metal, a number of potentially suitable binary intermetallic compounds may be formed with other metals. Such other metals include antimony, arsenic, barium, calcium, cerium, chromium, cobalt, copper, gadolinium, iron, lanthanum, lithium, magnesium, manganese, neodymium, nickel, niobium, platinum, strontium, tantalum, tellurium, thorium, titanium, tungsten, uranium, vanadium, ytterbium, yttrium, and zirconium.

TABLE 1

BINARY INTERMETALLIC COMPOUNDS FORMED FROM ALUMINUM AND OTHER METALS

| PRINCIPAL MATRIX METAL | OTHER METAL | INTERMETALLIC COMPOUND | WEIGHT % OF THE OTHER METAL IN THE COMPOUND |
|---|---|---|---|
| Al | As | AlAs | 73.5 |
| Al | Ba | $Al_4Ba$ | 56 |
| Al | Ca | $Al_4Ca$ | 27 |

TABLE 1-continued

| BINARY INTERMETALLIC COMPOUNDS FORMED FROM ALUMINUM AND OTHER METALS | | | |
|---|---|---|---|
| PRINCIPAL MATRIX METAL | OTHER METAL | INTERMETALLIC COMPOUND | WEIGHT % OF THE OTHER METAL IN THE COMPOUND |
| Al | Ce | $\alpha$ $Al_{11}Ce_3$ | 58.6 |
| Al | Co | $Al_9Co_2$ | 32.6 |
| Al | Cr | $Al_7Cr$ | 22 |
| Al | Cu | $Al_2Cu$ | 53 |
| Al | Fe | $Al_3Fe$ | 40 |
| Al | Gd | $AlGd_2$ | 92.1 |
| Al | La | $\alpha$ $Al_{11}La_3$ | 58.4 |
| Al | Li | $\beta$ | 17–24 |
| Al | Mg | $Al_3Mg_2$ | 36.1–37.8 |
| Al | Mn | $Al_6Mn$ | 25.2 |
| Al | Nb | $Al_3Nb$ | 53 |
| Al | Nd | $\alpha$ $Al_{11}Nd_3$ | 59.3 |
| Al | Ni | $Al_3Ni$ | 42 |
| Al | Pt | $Al_{21}Pt_5$ | 63.2 |
| Al | Sb | AlSb | 82 |
| Al | Sr | $Al_4Sr$ | 45 |
| Al | Ta | $Al_3Ta$ | 68 |
| Al | Te | $Al_2Te_3$ | 88 |
| Al | Th | $Al_7Th_2$ | 71 |
| Al | Ti | $Al_3Ti$ | 37 |
| Al | U | $Al_4U_{0.9}$ | 66.5 |
| Al | V | $Al_{21}V_2$ | 15.5 |
| Al | W | $\gamma$ | 37 |
| Al | Y | $\alpha$ $Al_3Y$ | 52 |
| Al | Yb | $Al_3Yb$ | 68 |
| Al | Zr | $Al_3Zr$ | 53 |

Furthermore, as shown in Table 2, the use of magnesium as the principal matrix metal can also provide for a number of potentially suitable binary intermetallic compounds which may be formed with other metals. Such other metals include aluminum, bismuth calcium, copper, gallium, gadolinium, germanium, lanthanum, nickel, lead, antimony, silicon, samarium, tin, strontium, thallium, ytterbium, and zinc.

TABLE 2

| BINARY INTERMETALLIC COMPOUNDS FORMED FROM MAGNESIUM AND OTHER METALS | | | |
|---|---|---|---|
| PRINCIPAL MATRIX METAL | OTHER METAL | INTERMETALLIC COMPOUND | WEIGHT % OF THE OTHER METAL IN THE COMPOUND |
| Mg | Al | $Mg_{17}Al_{12}$ | 50 |
| Mg | Bi | $Mg_3Bi_2$ | 83 |
| Mg | Ca | $Mg_2Ca$ | 45 |
| Mg | Cu | $Mg_2Cu$ | 57 |
| Mg | Ga | $Mg_5Ga_2$ | 53.4 |
| Mg | Gd | $Mg_5Gd$ | 56.4 |
| Mg | Ge | $Mg_2Ge$ | 60 |
| Mg | La | $Mg_2La$ | 32 |
| Mg | Ni | $Mg_2Ni$ | 54.7 |
| Mg | Pb | $Mg_2Pb$ | 81 |
| Mg | Sb | $\beta$ $Mg_3Sb_2$ | 77 |
| Mg | Si | $Mg_2Si$ | 36.6 |
| Mg | Sm | $Mg_{41}Sm_5$ | 43.1 |
| Mg | Sn | $Mg_2Sn$ | 71 |
| Mg | Sr | $Mg_{17}Sr_2$ | 30 |
| Mg | Tl | $Mg_5Tl_2$ | 77 |
| Mg | Yb | $\delta$ $Mg_2Yb$ | 77 |
| Mg | Zn | MgZn | 74 |

The use of principal matrix metals other than aluminum and magnesium can provide for an additional number of other potentially suitable binary intermetallic compounds which may be formed with other metals. A number of these principal matrix and other metals are presented in Table 3. As shown in Table 3, suitable principal matrix metals may include chromium, cobalt, copper, indium, molybdenum, nickel, niobium, silicon, strontium, tin, titanium, tungsten, vanadium, zinc, and zirconium. In the case of chromium, suitable other metals for the formation of the binary intermetallic compounds include niobium and zirconium. In the case of cobalt, a suitable other metal for the formation of the binary intermetallic compound includes tungsten. In the case of copper, suitable other metals for the formation of the binary intermetallic compounds include magnesium, titanium, and zirconium. In the case of indium, suitable other metals for the formation of the binary intermetallic compounds include antimony and strontium. In the case of molybdenum, suitable other metals for the formation of the binary intermetallic compounds include silicon and zirconium. In the case of nickel, suitable other metals for the formation of the binary intermetallic compounds include indium, titanium, yttrium, and zirconium. In the case of niobium, suitable other metals for the formation of the binary intermetallic compounds include cobalt and silicon. In the case of silicon, suitable other metals for the formation of the binary intermetallic compounds include vanadium and zirconium. In the case of strontium, suitable other metals for the formation of the binary intermetallic compounds include tin and zinc. In the case of tin, a suitable other metal for the formation of the binary intermetallic compound is strontium. In the case of titanium, suitable other metals for the formation of the binary intermetallic compounds include cobalt, nickel, and silicon. In the case of tungsten, a suitable other metal for the formation of the binary intermetallic compound includes nickel. In the case of vanadium, a suitable other metal for the formation of the binary intermetallic compound includes nickel. In the case of zinc, a suitable other metal for the formation of the binary intermetallic compound includes strontium. In the case of zirconium, suitable other metals for the formation of the binary intermetallic compounds include nickel, and silicon. For the purposes of this specification, the metalloids silicon, arsenic, and tellurium are considered metals.

TABLE 3

| BINARY INTERMETALLIC COMPOUNDS FORMED FROM VARIOUS MATRIX METALS AND OTHER METALS | | | |
|---|---|---|---|
| PRINCIPAL MATRIX METAL | OTHER METAL | INTERMETALLIC COMPOUND | WEIGHT % OF THE OTHER METAL IN THE COMPOUND |
| Co | W | $Co_3W$ | 50 |
| Cr | Nb | $Cr_2Nb$ | 48 |
| Cr | Zr | $Cr_2Zr$ | 47 |
| Cu | Mg | $Cu_2Mg$ | 17 |
| Cu | Ti | $Cu_4Ti$ | 16 |
| Cu | Zr | $Cu_9Zr_2$ | 24 |
| In | Sb | InSb | 52 |
| In | Sr | $In_5Sr$ | 13 |
| Mo | Si | $Mo_3Si$ | 9 |
| Mo | Zr | $Mo_2Zr$ | 36 |
| Nb | Co | $Nb_6Co_7$ | 37 |
| Nb | Si | $Nb_5Si_3$ | 16 |
| Ni | In | $Ni_3In$ | 40 |
| Ni | Ti | $Ni_3Ti$ | 38 |
| Ni | Y | $Ni_{17}Y_2$ | 15 |
| Ni | Zr | $Ni_3Zr$ | 34 |
| Si | V | $Si_2V$ | 47 |
| Si | Zr | $Si_2Zr$ | 62 |
| Sn | Sr | $Sn_4Sr$ | 16 |
| Sr | Sn | $Sr_2Sn$ | 40 |
| Sr | Zn | SrZn | 43 |
| Ti | Co | $Ti_2Co$ | 38 |
| Ti | Ni | $Ti_2Ni$ | 38 |
| Ti | Si | $Ti_3Si$ | 16 |

TABLE 3-continued

BINARY INTERMETALLIC COMPOUNDS FORMED FROM VARIOUS MATRIX METALS AND OTHER METALS

| PRINCIPAL MATRIX METAL | OTHER METAL | INTERMETALLIC COMPOUND | WEIGHT % OF THE OTHER METAL IN THE COMPOUND |
|---|---|---|---|
| V | Ni | $V_3Ni$ | 25 |
| W | Ni | $W_2Ni$ | 14 |
| Zn | Sr | $Zn_{13}Sr$ | 9 |
| Zr | Ni | $Zr_2Ni$ | 24 |
| Zr | Si | $Zr_3Si$ | 9 |

The principal matrix metals and intermetallic compounds listed in Tables 1-3 are exemplary in nature only and are not intended to limit the present invention as a number of other systems and intermetallic compounds may be useful in the practice of the invention.

The use of intermetallic compounds as reinforcing materials is advantageous as the interfacial properties between a metal and an intermetallic compound are typically superior to those between metal and ceramic particles. The interfaces between metals and intermetallic compounds are generally stronger than those between metals and ceramics. The superior interfacial properties between an intermetallic compound and a metal are especially accentuated in those instances wherein the intermetallic compound is partially comprised of the metal it contacts at the interface. Therefore composites of the present invention, which are composites having a matrix metal reinforced with intermetallic particulates that have a compositional metal in common, are expected to have generally superior interfacial and other properties relative to those composites comprised of matrix metals and intermetallic particulates that do not share a common compositional metal. The composites of the present invention may also have significantly superior mechanical properties as compared to those composites having a matrix metal reinforced with ceramic particulates.

Depending on the application to which the resultant discontinuously reinforced metal matrix composite is intended, the selection of a specific intermetallic particle for use as a reinforcing material may involve a variety of considerations. Such considerations can include the intermetallic particles density, elastic modulus, strength, and thermal stability. The relationships of these properties to those, and other, properties of the matrix metal are also considered. In various embodiments of the invention, the intermetallic particles are preferably intermetallic particles which have a low density, high elastic modulus, high strength, and good thermal stability. One such material is, for example, tri-aluminide of iron ($FeAl_3$). In one embodiment of the present invention, particulates of the intermetallic compound iron tri-aluminide ($FeAl_3$) are dispersed within an aluminum matrix to provide a discontinuously reinforced metal matrix composite.

In the various embodiments of this invention, the intermetallic particles should be present in the metal matrix in an amount necessary to increase the strength and stiffness of the metal matrix composite relative to those of the matrix metal alone. In the various embodiments of this invention, the intermetallic particles may be present in an amount ranging from about 10% to about 70% by volume. In other embodiments, the size of the intermetallic particulates, or phase, dispersed within the matrix metal may be about 20 μm or less, and preferably about 1 μm to 10 μm. In certain embodiments, the intermetallic particles dispersed in the matrix metal are both present in an amount ranging from about 10% to about 70% by volume and are of a size of about 20 μm or less, and preferably about 1 μm to 10 μm.

The invention also provides methods by which metal matrix composites reinforced with discontinuous intermetallic particles can be prepared. These methods can be divided into two general classes. The classes differ in that those processes in which the reinforcing intermetallic compound is added to a matrix metal are grouped into the first class. The second class includes those processes where the intermetallic compound is formed within the matrix metal. For both classes, the principal metal comprising the matrix metal is one of the two metals comprising the binary intermetallic compound.

In the first class, the discontinuously reinforced metal matrix composites may be prepared by combining a binary intermetallic compound with a matrix metal. Typically, the intermetallic compound is pulverized to the desired particle size prior to combination with the matrix metal. According to an embodiment in this class, the starting materials are individual powders, of a selected particle size, of the intermetallic compound and the matrix metal. The powders are blended and consolidated into a billet or product of the discontinuously reinforced metal matrix composite using powder metallurgy techniques. In a particular embodiment, this method includes the steps of: (1) separately producing atomized powders of the matrix metal and of the intermetallic compound; (2) blending of the matrix metal powder and intermetallic compound powder; (3) canning and degassing of the blended powders; (4) vacuum hot pressing to produce billets; and (5) hot extrusion into bars.

According to another embodiment in this class, the intermetallic compound is powdered to a preferred particle size and mixed with the molten matrix metal. Upon cooling, the result is a discontinuously reinforced metal matrix composite. It should be noted that homogeneity in the distribution of finer particles is often a problem with this processing route. The solubility of the intermetallic compound in the matrix metal(s) should be taken into consideration when selecting the type and amount of the matrix metal(s) and the intermetallic compound for use.

The second class of processes include those methods in which the reinforcing intermetallic compound is formed within the matrix metal. With this process, the intermetallic compound is formed by cooling a molten alloy consisting of minimally the principal matrix metal and the other metal. The alloy composition is selected using phase diagrams such that a given volume fraction of the intermetallic compound is formed, from the principal matrix metal and the other metal, with the cooling and solidification of the alloy. Such formation may be referred to as precipitation. The result of such cooling and solidification is that the desired volume fraction of intermetallic compound is uniformly distributed through the matrix metal.

Metal matrixes reinforced with discontinuous intermetallic particles may be prepared by cooling a molten alloy, minimally comprising the primary matrix metal and a sufficient quantity of the other metal, wherein the other metal is a metal capable of forming an intermetallic compound with the primary matrix metal, to precipitate the intermetallic compound as a particulate.

The rate at which the molten alloys of desired composition are cooled determines the size of the resultant intermetallic particles dispersed in the metal matrix. The size of these intermetallic particles is inversely related to the cooling rate of the alloy. That is high cooling rates produce small intermetallic particle sizes while low cooling rates produce large intermetallic particles. Routine experimental methods well known to those skilled in the art may be used to identify those cooling rates that result in dispersed intermetallic particles having the desired particle size. The cooling rates required to produce the intermetallic particle sizes of the invention are typically very rapid. Such high cooling rates may be obtained using gas atomization of the alloy. Alternatively, it may be possible to utilize other rapid cooling methods such as, but not limited to, splat cooling.

For an embodiment in the second class, the discontinuously intermetallic particulate reinforced metal matrix composites may be produced by casting of a molten, liquid metal containing both the principal matrix metal and the other metal of the intermetallic compound. Upon cooling, the intermetallic compound forms within the matrix metal. Such liquid metal casting is one of the methods by which an alloy of the desired composition is directly cast to obtain intermetallic particulates dispersed in the aluminum matrix. Direct metal casting, however, typically results in coarser intermetallic particles as a result of the slower cooling rates inherent to bulk castings. Generally it is not possible to obtain the desired fine particles of a micron size range by direct casting methods.

Another embodiment included in the second class is rapid solidification processing (RSP). RSP is a method that may be used to produce the metal matrix composites of the present invention from a molten alloy, minimally comprising the principal matrix metal, and a sufficient quantity of at least one other metal capable of forming an intermetallic compound in combination with the matrix metal. High cooling rates of the molten metal can be achieved by techniques such as splat cooling. The resulting powder or splat or thin ribbon are consolidated by methods known in the associated arts into a billet or other products. In the case of splat or thin ribbons produced by rapid solidification, further processing typically involves an additional step of comminution, in which the splat or ribbon is converted to powder prior to consolidation into a billet.

Another embodiment included in the second class involves the direct atomization of a molten alloy, minimally comprising the principal matrix metal and a sufficient quantity of at least one other metal, wherein the other metal is capable of forming an intermetallic compound in combination with the principal matrix metal. Such direct atomization results in the "in-situ" precipitation of fine intermetallic, typically crystalline, particulates within the resulting metal matrix composite powder. This embodiment generally provides a higher level of homogeneity of particle distribution than the other methods. This embodiment also eliminates the powder preparation and blending steps of standard powder metallurgy processing methods. Additionally, this embodiment readily provides for the production of metal matrix composites reinforced with particulate intermetallic compounds wherein the intermetallic compounds are present in an amount ranging from about 10% to about 70% by volume and are of a size of about 20 μm or less (preferably about 1 μm to 10 μm).

The above method for the production of a discontinuously reinforced metal matrix composite may be considered a combination of rapid solidification and powder metallurgy techniques. By this method, inert gas atomization of molten alloys of desired composition produces metal matrix composite powders reinforced with intermetallic particles of the desired size dispersed within the particles. Therefore the metal matrix composite powder particles are composites of intermetallic particles dispersed in the matrix metal. The cooling rate of the alloy is related to the resultant powder particle size. That is, the smaller the powder particle size, the greater is the cooling rate. As was previously discussed, the intermetallic particle size varies inversely with the cooling rate. Therefore, finer and/or coarser powder sizes may be used for further processing to vary the intermetallic particulate size of the metal matrix composite.

The size of the resultant metal matrix composite powder particles determines the cooling rate of these particles. As such, selection of the powder size can be the basis for varying the intermetallic particulate size. In various embodiments of this method, the size of the intermetallic particulates, or phase, dispersed within the matrix metal is about 20 μm or less, and preferably about 1 μm to 10 μm. In other embodiments of this method of the present invention, the intermetallic particles are present in the matrix metal in an amount ranging from about 10% to about 70% by volume. In another embodiment, the intermetallic particles dispersed in the matrix metal are both present in an amount ranging from about 10% to about 70% by volume and are of a size of about 20 μm or less, and preferably about 1 μm to 10 μm.

The resulting metal matrix composite powders produced by inert gas atomization may be consolidated through powder metallurgy routes of processing which include vacuum hot pressing followed by hot extrusion to obtain metal matrix composite bars of round or rectangular cross-section. The resulting bars may then be fabricated into structural supports, parts, assemblages, and the like, as desired.

The following is an exemplary example of an application of powder metallurgy techniques to an embodiment of the second class to result in the discontinuous reinforced metal matrix composites of the invention. In this example, aluminum is used as the principal matrix metal and $FeAl_3$ is used as the intermetallic compound which is the reinforcing particle or phase. However, as discussed above, various metals and intermetallic particles may be used.

An Al—Fe alloy composition is selected from phase diagrams to provide a given volume fraction of $FeAl_3$. The volume fraction of the $FeAl_3$ is between about 10% and 70%. A liquid or molten alloy of the selected composition is inert gas atomized to produce powder particles comprising an aluminum matrix containing dispersed $FeAl_3$ particles which are formed during the rapid solidification of the liquid alloy. Preferably the gas atomization is conducted such that the size of the intermetallic particulates, or phase, dispersed within the aluminum matrix metal is about 20 μm or less, and preferably about 1 μm to 10 μm. Next, the powder particles are optionally sieved, or otherwise sized, to obtain composite particles in the desired size range. The size of the composite particles determines the cooling rate of those particles, which in turn determines the intermetallic particle size within those composite particles. The size range of the intermetallic particles within the composite particles is typically dependent upon the composite particle size range. The powder is then canned, degassed and vacuum hot pressed to produce billets. Bars, or other structural elements, may be formed from the billet using for example, hot extrusion. In particular, to can the powder, for example, the powder particles may be initially subjected to cold compaction during which the powder is canned at about room temperature or slightly higher and then subjected to hard compaction during which the canned powder is pressure packed into a container and heated.

The invention provides a metal matrix composite wherein the reinforcing material is a particulate binary intermetallic compound wherein the binary intermetallic compound is comprised of the same type of metal as is the principal matrix metal and one other metal. Additionally, this invention provides for good control of the size range and distribution of the intermetallic particles especially through the rapid solidification and powder metallurgy (P/M) route of processing. The resulting intermetallic/metal matrix composites according to this invention have improved properties as compared to metal/ceramic particulate composites for a given particulate size and volume fraction of reinforcing particles.

It is expected that many of the methods and embodiments previously discussed, will have utility for the preparation of discontinuously reinforced metal composites, having intermetallic compound reinforcement, which do not utilize binary intermetallic compounds as the reinforcing material. Additionally, such intermetallic compounds may comprise a metal other than the principal matrix metal.

The invention has been described above with respect to certain preferred embodiments and should not be limited to such preferred embodiments. The invention should only be limited by the following claims.

What is claimed is:

1. A discontinuously reinforced metal composite, consisting essentially of:

a matrix metal comprising a principle matrix metal; and a plurality of intermetallic particles, the intermetallic particles having a size ranging from 1 μm to about 10 μm and being dispersed within the metal matrix in an amount ranging from greater than 40% by volume to about 70% by volume, wherein said intermetallic particles comprise binary intermetallic compounds comprised of the principal matrix metal and one other metal.

2. The discontinuously reinforced metal composite of claim 1, wherein said principal matrix metal is aluminum.

3. The discontinuously reinforced metal composite of claim 2, wherein said other metal is one of the group of antimony, arsenic, barium, calcium, cerium, chromium, cobalt, copper, gadolinium, iron, lanthanum, lithium, magnesium, manganese, neodymium, nickel, niobium, platinum, strontium, tantalum, tellurium, thorium, titanium, tungsten, uranium, vanadium, ytterbium, yttrium, and zirconium.

4. The discontinuously reinforced metal composite of claim 1, wherein said principal matrix metal is magnesium.

5. The discontinuously reinforced metal composite of claim 4, wherein said other metal is one of the group of aluminum, bismuth calcium, copper, gallium, gadolinium, germanium, lanthanum, nickel, lead, antimony, silicon, samarium, tin, strontium, thallium, ytterbium, and zinc.

6. The discontinuously reinforced metal composite of claim 1, wherein said principal matrix metal is chromium.

7. The discontinuously reinforced metal composite of claim 6, wherein said other metal is one of the group of niobium and zirconium.

8. The discontinuously reinforced metal composite of claim 1, wherein said principal matrix metal is cobalt.

9. The discontinuously reinforced metal composite of claim 8, wherein said other metal is tungsten.

10. The discontinuously reinforced metal composite of claim 1, wherein said principal matrix metal is copper.

11. The discontinuously reinforced metal composite of claim 10, wherein the said other metal is one of the group of magnesium, titanium, and zirconium.

12. The discontinuously reinforced metal composite of claim 1, wherein said principal matrix metal is indium.

13. The discontinuously reinforced metal composite of claim 12, wherein said other metal is one of the group of antimony and strontium.

14. The discontinuously reinforced metal composite of claim 1, wherein said principal matrix metal is molybdenum.

15. The discontinuously reinforced metal composite of claim 14, wherein said other metal is one of the group of silicon and zirconium.

16. The discontinuously reinforced metal composite of claim 1, wherein said principal matrix metal is nickel.

17. The discontinuously reinforced metal composite of claim 16, wherein said other metal is one of the group of indium, titanium, yttrium, and zirconium.

18. The discontinuously reinforced metal composite of claim 1, wherein said principal matrix metal is niobium.

19. The discontinuously reinforced metal composite of claim 18, wherein said other metal is one of the group of cobalt and silicon.

20. The discontinuously reinforced metal composite of claim 1, wherein said principal matrix metal is silicon.

21. The discontinuously reinforced metal composite of claim 20, wherein said other metal is one of the group of vanadium and zirconium.

22. The discontinuously reinforced metal composite of claim 1, wherein said principal matrix metal is strontium.

23. The discontinuously reinforced metal composite of claim 22, wherein said other metal is one of the group of tin and zinc.

24. The discontinuously reinforced metal composite of claim 1, wherein said principal matrix metal is tin.

25. The discontinuously reinforced metal composite of claim 24, wherein said other metal is strontium.

26. The discontinuously reinforced metal composite of claim 1, wherein said principal matrix metal is titanium.

27. The discontinuously reinforced metal composite of claim 26, wherein said other metal is one of the group of cobalt, nickel, and silicon.

28. The discontinuously reinforced metal composite of claim 1, wherein said principal matrix metal is tungsten.

29. The discontinuously reinforced metal composite of claim 28, wherein said other metal is nickel.

30. The discontinuously reinforced metal composite of claim 1, wherein said principal matrix metal is vanadium.

31. The discontinuously reinforced metal composite of claim 30, wherein said other metal is nickel.

32. The discontinuously reinforced metal composite of claim 1, wherein said principal matrix metal is zinc.

33. The discontinuously reinforced metal composite of claim 32, wherein said other metal is strontium.

34. The discontinuously reinforced metal composite of claim 1, wherein said principal matrix metal is zirconium.

35. The discontinuously reinforced metal composite of claim 1, wherein said other metal is one of the group of nickel and silicon.

* * * * *